US006798722B2

(12) United States Patent
Miyama

(10) Patent No.: US 6,798,722 B2
(45) Date of Patent: Sep. 28, 2004

(54) HAND AND TIMEPIECE USING THE HAND

(75) Inventor: Shigeru Miyama, Chiba (JP)

(73) Assignee: Seiko Instruments Inc., Chiba (JP)

( * ) Notice: Subject to any disclaimer, the term of this patent is extended or adjusted under 35 U.S.C. 154(b) by 12 days.

(21) Appl. No.: 10/315,639

(22) Filed: Dec. 10, 2002

(65) Prior Publication Data

US 2003/0107952 A1 Jun. 12, 2003

(30) Foreign Application Priority Data

Dec. 11, 2001 (JP) ..... 2001-376684

(51) Int. Cl.[7] ..... G04D 3/00; G04B 19/04
(52) U.S. Cl. ..... 368/238; 29/896.3
(58) Field of Search ..... 368/223, 228, 368/238; 29/896.3

(56) References Cited

U.S. PATENT DOCUMENTS 5,697,322 A * 12/1997 Hay et al. ..... 116/286
6,519,853 B1 * 2/2003 Machida et al. ..... 29/896.3

* cited by examiner

*Primary Examiner*—Vit W. Miska
(74) *Attorney, Agent, or Firm*—Adams & Wilks

(57) ABSTRACT

To provide a hand, free from hand deviation and disengagement, having integrated engaging and wing portions and formed of a low-density material.

A hand body has a wing portion for pointing a position and an engaging portion for engagement with a spindle of a movement, by a material having a density lower than a brass material. The wing portion and the engaging portion are integrally formed. On a surface of the hand body, first plating is made in order to enhance the strength after a substitution treatment. Then, second plating is made for ornament on the first plating.

18 Claims, 3 Drawing Sheets

| MATERIAL KIND | DENSITY (g/cm3) |
|---|---|
| PURE Al | 2.7 |
| Al ALLOY | 2.7 |
| Mg | 1.8 |
| RESIN (ABS) | 1.1 |
| BRASS (FOR COMPARISON) | 8.5 |

| MATERIAL KIND | Ni-PLATING THICKNESS AT ENGAGING PORTION (μm) | MINUTE HAND WEIGHT (mg) | PRIMARY MOMENT (mg-mm) |
|---|---|---|---|
| PURE Al | ——— | 3.9 | 16.8 |
| PURE Al | 3.0 | 4.4 | 19.2 |
| PURE Al | 5.0 | 4.8 | 20.5 |
| PURE Al | 10.0 | 5.6 | 24.2 |
| PURE Al | 15.0 | 6.5 | 28.0 |
| Al ALLOY | ——— | 3.9 | 16.8 |
| Al ALLOY | 5.0 | 4.8 | 20.5 |
| Al ALLOY | 10.0 | 5.6 | 24.2 |
| Mg | ——— | 2.2 | 9.5 |
| Mg | 5.0 | 3.1 | 13.2 |
| Mg | 10.0 | 4.8 | 16.9 |
| RESIN (ABS) | ——— | 1.4 | 3.1 |
| RESIN (ABS) | 5.0 | 2.3 | 6.8 |
| RESIN (ABS) | 10.0 | 4.0 | 10.5 |
| BRASS (FOR COMPARISON) | ——— | 12.3 | 53.0 |

FIG. 4

| MATERIAL KIND | Ni-PLATING THICKNESS AT ENGAGING PORTION (μm) | CHANGE IN PUSH FORCE WHEN HAND ASSEMBLING IS REPEATED ( /kg) | | | | |
|---|---|---|---|---|---|---|
| | | 1ST TIME | 2ND TIME | 3RD TIME | 4TH TIME | 5TH TIME |
| PURE Al | 3.0 | 2.4 | 2.3 | 2.3 | 2.2 | 2.2 |
| PURE Al | 5.0 | 3.4 | 3.2 | 3.1 | 2.9 | 2.9 |
| PURE Al | 10.0 | 4.1 | 3.4 | 3.3 | 3.3 | 3.3 |
| PURE Al | 15.0 | 4.5 | 3.6 | 3.3 | 3.3 | 3.3 |
| Al ALLOY | ——— | 2.0 | 1.4 | 1.3 | 1.3 | 1.2 |
| Al ALLOY | 5.0 | 3.6 | 3.1 | 3.1 | 2.9 | 2.9 |
| Al ALLOY | 10.0 | 4.4 | 3.2 | 3.2 | 3.1 | 3.1 |
| Mg | 5.0 | 3.0 | 3.0 | 2.9 | 2.9 | 2.9 |
| Mg | 10.0 | 4.1 | 3.0 | 3.0 | 2.9 | 2.8 |
| RESIN (ABS) | 5.0 | 2.7 | 2.5 | 2.3 | 2.3 | 2.2 |
| RESIN (ABS) | 10.0 | 3.1 | 3.0 | 2.8 | 2.7 | 2.7 |
| BRASS (FOR COMPARISON) | ——— | 2.7 | 2.5 | 2.3 | 2.3 | 2.3 |

FIG. 5

| MATERIAL KIND | Ni-PLATING THICKNESS AT ENGAGING PORTION (μm) | CHANGE IN REMOVAL FORCE WHEN HAND ASSEMBLING IS REPEATED( /kg) | | | | |
|---|---|---|---|---|---|---|
| | | 1ST TIME | 2ND TIME | 3RD TIME | 4TH TIME | 5TH TIME |
| PURE Al | 3.0 | 0.48 | 0.42 | 0.34 | 0.34 | 0.34 |
| PURE Al | 5.0 | 0.50 | 0.42 | 0.37 | 0.37 | 0.37 |
| PURE Al | 10.0 | 0.51 | 0.48 | 0.47 | 0.45 | 0.43 |
| PURE Al | 15.0 | 0.60 | 0.50 | 0.46 | 0.46 | 0.48 |
| Al ALLOY | ——— | 0.32 | 0.28 | 0.24 | 0.21 | 0.21 |
| Al ALLOY | 5.0 | 0.46 | 0.42 | 0.42 | 0.40 | 0.40 |
| Al ALLOY | 10.0 | 0.55 | 0.46 | 0.42 | 0.42 | 0.40 |
| Mg | 5.0 | 0.52 | 0.38 | 0.32 | 0.32 | 0.32 |
| Mg | 10.0 | 0.53 | 0.45 | 0.43 | 0.36 | 0.36 |
| RESIN (ABS) | 5.0 | 0.41 | 0.34 | 0.30 | 0.30 | 0.30 |
| RESIN (ABS) | 10.0 | 0.48 | 0.46 | 0.45 | 0.42 | 0.40 |
| BRASS (FOR COMPARISON) | ——— | 0.52 | 0.47 | 0.40 | 0.32 | 0.32 |

HAND AND TIMEPIECE USING THE HAND

BACKGROUND OF THE INVENTION

This invention relates to a hand using a low density material and a timepiece using the hand.

The conventional hands, generally, use brass material excellent in workability, strength and surface treatability as wristwatch hands. Consequently, brass material has a density as heavy as 8.5 g/cm$^3$, and hand length width undergoes great restriction due to a drive force of a wristwatch mechanical movement.

Meanwhile, in the case a light-weighted hand is to be employed in relation to a drive force of a wristwatch mechanical movement, used is a two-bodied hand combining an engaging portion and a wing portion after separately fabricated.

The conventional hand, because using a brass material, is excellent in workability, strength and ornamentality. On the contrary, because the density is as heavy as 8.5 g/cm$^3$, a great hand drive force is required where used on a timepiece. However, the timepiece needs to reduce hand drive force and decrease power consumption to a possible low extent, in order to prolong battery life. For this reason, the use of a conventional hand restricts a length or width of the hand. This has an effect upon viewability. As a result, there are an increasing number of pointing out of time illegibility by the aged persons and the like.

On the other hand, in case directly using an aluminum material having a density 2.7 g/cm$^3$, a magnesium material having a density 1.8 g/cm$^3$ or a resin material having a density 1.1 g/cm$^3$ which are considered light-weighted, deformation occurs in the engaging portion because of absence of a material strength required for the hand. Consequently, hand deviation or disengagement takes place due to impact or the like. Meanwhile, for the conventional hand, it is to be considered to combine an engaging portion and a wing portion after separately fabricated (hereinafter, referred to as "two-bodied hand"). The two-bodied hand tends to have increasing manufacturing cost for the hand itself. In the case of using a two-bodied hand, there additionally requires at least two parts for hour and minute hands. In the case of a multi-spindle hand, there are additional requirements corresponding to the number of spindles. Also, it will be expensive if assembling cost is included, and hence adoption is limitative.

Therefore, the invention is to solve the foregoing problem and to provide a hand having an integrated engaging and wing portions formed of a low density material not to cause hand deviation or disengagement. Due to this, even for a timepiece of a low power consumption type smaller in movement drive force, it is possible to use a longer hand or wider hand than the conventional, thus making possible to enhance viewability. Furthermore, much use of a light-storing material enables to enhance viewability furthermore.

Also, because of an integrated hand not requiring many parts, supply is feasible at a price unchanged from the conventional.

SUMMARY OF THE INVENTION

A hand of this invention comprising: a hand body having a wing portion for pointing a position and an engaging portion for engagement with a spindle of a movement, the wing portion and the engaging portion being integrally formed of a material having a density lower than a brass material; a first plating layer provided by making a plating on a surface of the hand body in order to improve strength after a substitution treatment; and a second plating layer provided by making a plating for ornament on the first plating layer.

Even if using a material having a density lower than a brass member (density 8.5 g/cm$^3$) (hereinafter, referred to as "low density material"), a hand can be integrally structured without making two bodies of a wing portion and an engaging portion. Due to this, a light-weighted hand can be provided.

In a hand of the invention, the first plating layer is either nickel plating or copper plating.

The use of nickel plating or copper plating can improve strength of the hand.

In a hand of this invention, the material of the hand body is of pure aluminum or an aluminum alloy. Due to this, a light-weighted hand can be provided.

In a hand of this invention, the material of the hand body is of pure magnesium or a magnesium alloy. Due to this, a light-weighted hand can be provided.

In a hand of this invention, the material of the hand body is of a resin material. Due to this, a light-weighted hand can be provided.

In a hand of this invention, the hand has the first plating layer having a plating total thickness, of plating to be made on the engaging portion, of 3 $\mu$m or greater and 10 $\mu$m or smaller. Due to this, a luster required as an ornament can be obtained.

A timepiece of this invention uses the foregoing hand. By using such a hand on a timepiece, a long or wide hand can be attached even on a timepiece smaller in hand drive force. In particular, because even a small-sized movement can use a large-sized hand, viewability can be improved.

BRIEF DESCRIPTION OF THE DRAWINGS

FIG. 4 is a figure representing a change in hand pushing force in the case hand assembling is repeated; and FIG. 5 is a figure representing a change in hand removal force in the case hand assembling is repeated.

DETAILED DESCRIPTION OF THE PREFERRED

Figures 1, 2, 3:
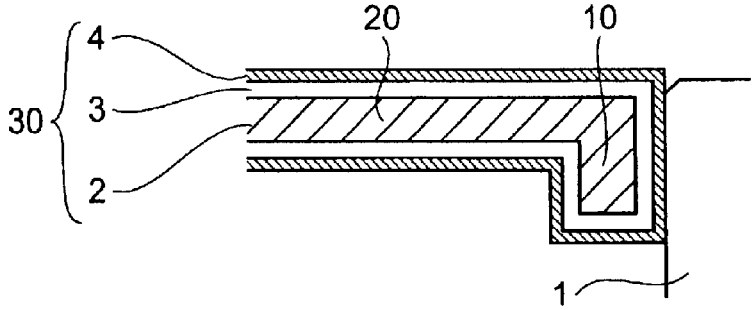
FIG. 1 is a sectional view of a hand in an embodiment according to this invention.
FIG. 2 is a figure comparing material densities.
FIG. 3 is a figure showing a Ni plating thickness, minute hand weight and primary moment for each material.

An embodiment of the present invention will be explained on the basis of the drawings. FIG. 1 shows a sectional view of a hand. Incidentally, this embodiment shows an example that a hand of the invention is used as a hand for a timepiece. In this embodiment, respective materials are an aluminum material having a density 2.7 g/cm$^3$, a magnesium material having a density 1.8 g/cm$^3$ and a resin having a density 1.1 g/cm$^3$ which are light-weighted.

Worked are a resin material by injection-molding and a metal material by cold or hot press, into a watch hour-hand, minute-hand form. At this time, a hand body 2 is integrally formed in a shape having a wing portion 20 for pointing a position for a scale provided on a dial, dial ring or the like and an engaging portion 10 in a cylindrical form for engagement on a spindle 1 of a movement. Thereafter, in order to improve adhesibility, substitution plating is carried out. Still thereafter, a plating layer 3 is provided by a wet plating method, for the purpose of increasing strength. Furthermore, finish plating 4 is carried out for the purpose of ornamentation. By the method like this, a hand 30 is fabricated.

The plating 3, on the watch hand 30 for the purpose of increasing strength, is carried out such that a plating total thickness is 3 μm or greater and 10 μm or smaller at the engaging portion 10 of between the watch movement and the hand. The reason the plating-layer total thickness is given 3 μm or greater at the engaging portion 10 of the hand 30 coupling to the watch movement for the purpose of increasing strength is because, if smaller than 3 μm, despite the initial quality is satisfactory, the engaging portion 10 of the hand 30 possibly plastic-deformed due to aging if the hand 30 is removed and assembled twice and trice. Due to this, there arises a problem, such as hand deviation or disengagement, even by a light impact. Such a phenomenon might be problematic in consideration of watch after-sale service.

Meanwhile, in the case of carrying out plating on an aluminum material or magnesium material, in order to obtain a required adhesibility, there is a need of substitution plating after pre-treating a surface of the hand 30 into roughening and glooming. In case a plating layer 3 to be followed for the purpose of strength increase is small in thickness, luster is lost and ornamental-product value is also lost. In order to obtain a hand having a luster required as an ornament by a plating leveling action, preferred is a plating thickness of 3 μm or greater.

The reason the total thickness of the plating layer 3 for the purpose of strength increase is given 10 μm or smaller at the engaging portion 10 is because, with 10 μm or greater, there is increase of a hand-pushing force onto the movement in assembling the hand, thus possibly having an effect upon the movement. Also, plating in excess of functional requirement is economically wasteful.

The densities of a comparative brass material and materials according to the invention are shown in FIG. 2. As compared to the brass material, the density is approximately from about 32% to about 12%.

In FIG. 3 are shown a weight and a primary moment when, using materials in FIG. 2, a material having a thickness of 0.15 mm is worked into a wristwatch minute hand form to carry out Ni plating according to the invention together with a comparative brass hand. It is seen that the primary moment is approximately a half or less as compared to that of brass.

In FIG. 4 is shown a representative example, using the hand of FIG. 3, of a plate thickness at the engaging portion in the case of assembling on a wristwatch and a change in the hand-pushing force required for assembling in the case the hand thereof is repeatedly assembled and removed. In the case of pure Al, the pushing force in the first time is somewhat lower as compared to brass when the Ni plating thickness at the engaging portion is 3.0 μm. However, it may be considered nearly the same if considering with the pushing force in the fifth time. In the case of Al alloy, in case Ni plating is not done at all, the pushing force reduces to a half of that of brass in the fifth time if repeating hand assembling. In case Ni plating is done, the pushing force is higher than that of brass. In the case of Mg, it is higher than brass similarly to the case of Al alloy. In the case of resin, Ni plating by 5 μm can provide nearly the same pushing force as in the case of brass.

In FIG. 5 is shown a representative example, using the hand of FIG. 3, of a plate thickness at the engaging portion in the case assembled on a wristwatch and a change in the hand-removal force in the case of repeating the assembling and removal of the hand. In every material, the removal force in the fifth time after repeating hand assembling is equivalent to or higher than that of brass. Accordingly, the removal force is considered equal to or higher than that of brass.

The hand of this invention, as explained above, can possess a push-in force or removal force nearly equivalent or higher as compared to the brass-made hand of the conventional product. In case such a hand is used on a timepiece, drive force is satisfactorily smaller because of having quality and light in weight (low power consumption), making possible to provide a product longer in battery life.

Also, with the same drive force (consumption power), it is possible to provide a product attached with a hand that is long and excellent in viewability.

What is claimed is:

1. A hand comprising:

a hand body having a wing portion for pointing a position and an engaging portion for engagement with a spindle of a movement, wherein the wing portion and the engaging portion being integrally formed of a material having a density lower than a brass material;

a first plating layer provided by making a plating on a surface of the hand body in order to improve strength after a substitution treatment; and a second plating layer provided by making a plating on the first plating layer for ornament.

2. A hand according to claim 1, wherein the material of the first plating layer is nickel plating.

3. A hand according to claim 1, wherein the material of the first plating layer is copper plating.

4. A hand according to claim 1, wherein the material of the hand body is pure aluminum.

5. A hand according to claim 1, wherein the material of the hand body is aluminum alloy.

6. A hand according to claim 1, wherein the material of the hand body is pure magnesium.

7. A hand according to claim 1, wherein the material of the hand body is magnesium alloy.

8. A hand according to claim 1, wherein the material of the hand body is a resin material.

9. A hand according to claim 1, wherein the first plating layer has a plating total thickness, of plating to be made on the engaging portion, of 3 μm or greater and 10 μm or smaller.

10. A timepiece comprising:

a hand having a wing portion for pointing a position and an engaging portion for engagement with a spindle of a movement as a hand body, wherein the wing portion and the engaging portion being integrally formed of a material having a density lower than a brass material;

a first plating layer provided by making a plating on a surface of the hand body in order to improve strength after a substitution treatment; and a second plating layer provided by making a plating on the first plating layer for ornament.

11. A timepiece according to claim 10, wherein the material of the first plating layer is nickel plating.

12. A timepiece according to claim 10, wherein the material of the first plating layer is copper plating.

13. A timepiece according to claim 10, wherein the material of the hand body is pure aluminum.

14. A timepiece according to claim 10, wherein the material of the hand body is aluminum alloy.

15. A timepiece according to claim 10, wherein the material of the hand body is pure magnesium.

16. A timepiece according to claim 10, wherein the material of the hand body is magnesium alloy.

17. A timepiece according to claim 10, wherein the material of the hand body is of a resin material.

18. A timepiece according to claim 10, wherein the first plating layer of the hand has a plating total thickness, of plating to be made on the engaging portion, of 3 $\mu$m or greater and 10 $\mu$m or smaller.

* * * * *